US005197897A

United States Patent [19]

Torok

[11] Patent Number: 5,197,897

[45] Date of Patent: * Mar. 30, 1993

[54] LOCKING CORD CONNECTOR AND METHOD OF LOCKING AN ELECTRICAL PLUG AND RECEPTACLE TOGETHER

[76] Inventor: Dale W. Torok, 1105 North Broadway, Lexington, Ky. 40505

[ * ] Notice: The portion of the term of this patent subsequent to Apr. 28, 2009 has been disclaimed.

[21] Appl. No.: 874,726

[22] Filed: Apr. 27, 1992

Related U.S. Application Data

[63] Continuation-in-part of Ser. No. 664,456, Feb. 28, 1991, Pat. No. 5,108,301, which is a continuation of Ser. No. 482,075, Feb. 16, 1990, abandoned.

[51] Int. Cl.[5] ..... H01R 13/15; H01R 13/635

[52] U.S. Cl. ..... 439/263; 439/105; 439/265

[58] Field of Search ..... 439/324, 347, 259, 261, 439/263, 265, 270, 140, 141, 638, 651, 711, 713, 825, 826, 262, 268, 835, 836, 843, 844, 299, 300, 628, 105

[56] References Cited

U.S. PATENT DOCUMENTS

| | | | |
|---|---|---|---|
| 1,917,009 | 7/1933 | Betts et al. | 439/262 |
| 2,261,615 | 11/1941 | Cornwell | 439/265 |
| 2,380,908 | 7/1945 | Heller | 439/847 |
| 2,474,454 | 6/1949 | Avery | 439/259 |
| 2,716,737 | 8/1955 | Maberry | 439/176 |
| 2,799,009 | 7/1957 | Benander | 439/346 |
| 3,267,408 | 8/1966 | Baker et al. | 439/270 |
| 3,542,218 | 11/1970 | Archer | 439/266 |
| 4,544,216 | 10/1985 | Imhoff | 439/106 |
| 4,627,681 | 12/1986 | Hong | 439/263 |
| 4,867,697 | 9/1989 | Borges | 439/265 |

*Primary Examiner*—Neil Abrams

*Attorney, Agent, or Firm*—King and Schickli

[57] ABSTRACT

A locking electrical cord connector includes a two piece housing formed from electrically non-conductive material. A pair of conductors are received in the housing. Each conductor includes a male electrical contact and a female electrical contact. Two locking mechanisms are also provided in the housing. The first cooperates with the male electrical contacts for locking the male electrical contacts to a receptacle. The second cooperates with the female electrical contacts for locking the female electrical contact to a plug of another electrical appliance. More particularly, each of the locking mechanisms includes a spring metal element. The distal end of each spring metal element associated with a male contact is bradded to the male contact. The distal end of each spring metal element associated with a female contact is fixed in a notch in the housing. The proximal ends of the spring metal elements are received in slots cut in opposed slide blocks. These slide blocks are held for limited reciprocal movement within a chamber in the housing. A lever controlled cam actuator cooperates with the slide blocks and allows the locking cord connector to be locked and unlocked. When locked, the spring metal elements bow to provide frictional binding action.

17 Claims, 2 Drawing Sheets

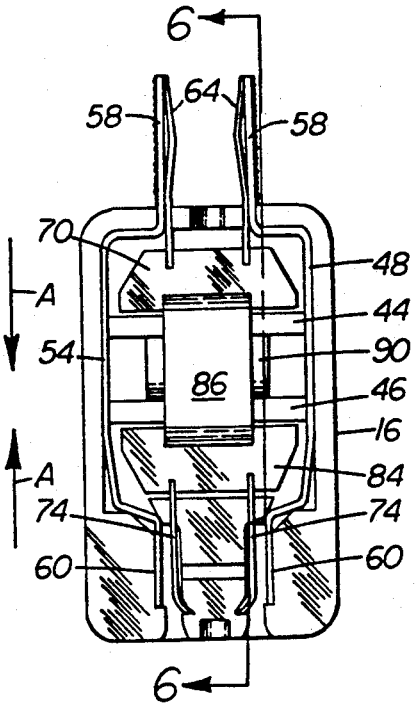
Fig 4
Fig 5
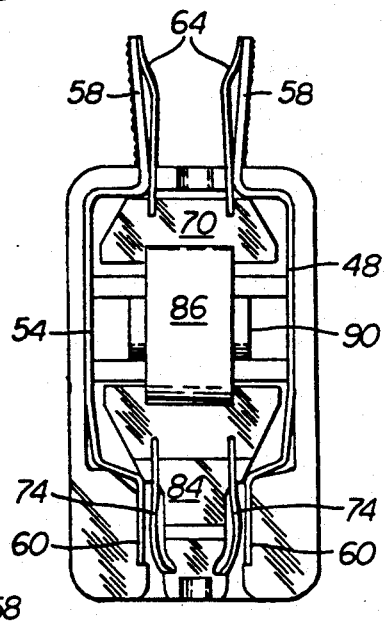
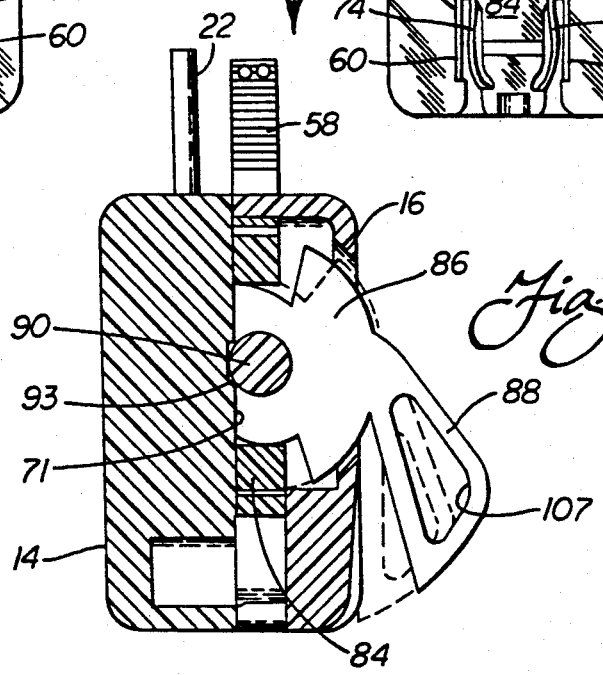
Fig 6
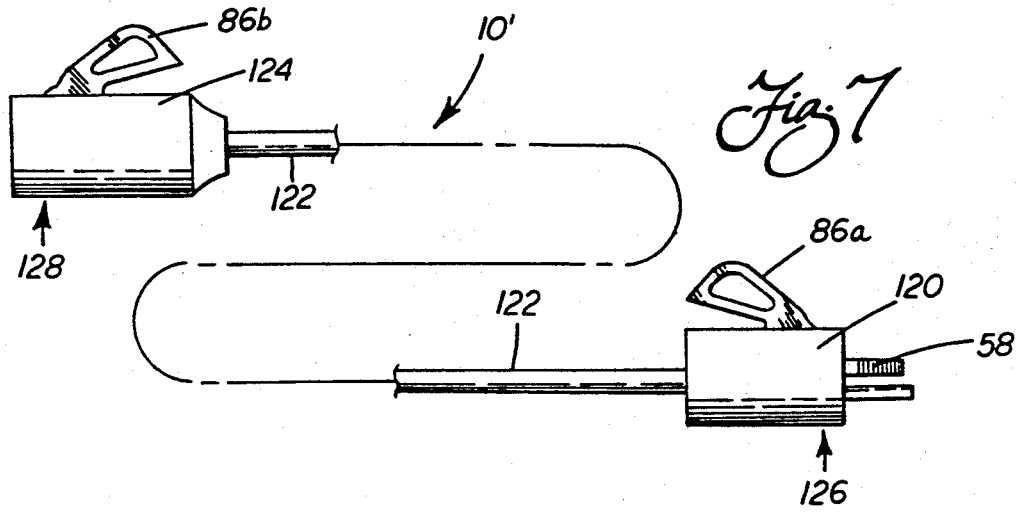
Fig 7

LOCKING CORD CONNECTOR AND METHOD OF LOCKING AN ELECTRICAL PLUG AND RECEPTACLE TOGETHER

This application is a continuation-in-part of U.S. patent application, Ser. No. 664,456, now U.S. Pat. No. 5,108,301, issued on Apr. 28, 1992, which is a continuation of U.S. patent application Ser. No. 482,075, filed Feb. 16, 1990, now abandoned.

TECHNICAL FIELD

The present invention relates generally to electrical connectors and, more particularly, to a locking electrical cord connector that securely attaches at both the male and female ends.

BACKGROUND OF THE INVENTION

Nearly everyone at one time or another has experienced the inconvenience and frustration of having the plug of an electrical appliance become disengaged or uncoupled from an electrical wall outlet or the female end of an extension cord. This often occurs while attempting to operate a hand-manipulated appliance. For example, housewives operating a vacuum cleaner often experience the plug at the end of the vacuum cleaner cord becoming disengaged from a cooperating receptacle of an extension cord or from the wall outlet. As another example, carpenters operating drills and/or circular saws at a construction job site often experience this same difficulty. This can be particularly disruptive to the effective completion of work in this situation where long extension cords are often utilized and the individual may have to, for example, climb down a ladder, walk a significant distance to reengage the plug in the receptacle and then climb back up the ladder to return to the work area.

In many situations, carpenters and other individuals have resorted to tying the adjacent ends of electrical cords together to prevent disengagement of the cooperating plug and receptacle. While this procedure does prevent disengagement, it is not a very effective solution to the problem for a number of reasons. First, it is a relatively time consuming procedure. Second, repeated tying of a cord places a significant strain upon the electrical conductors in the cord. Over time the conductors may be damaged to an extent that at the very least renders the cord useless and in certain situations could potentially lead to a dangerous direct short. Third, it should also be appreciated that it is not possible to tie an electrical cord to a flush mounted wall outlet. Accordingly, this approach cannot be used in this instance to avoid disconnection. Fourth, this procedure does nothing to improve the electrical connection between the male and female connectors.

Recognizing these and other problems, various devices have been developed for maintaining electrical plugs and receptacles in a connected condition. For example, U.S. Pat. No. 4,784,612 to Ryan discloses a hollow capsule including cooperating male and female sections. The electrical plug and receptacle are engaged and placed in the cooperating sections. Next, the sections are threaded together to tightly press the plug and receptacle together. While this device is effective in holding a plug and receptacle of two cords together, it must be appreciated that the device is relatively cumbersome and time consuming to utilize. The device is also not capable of functioning to hold a plug in a flush mounted wall outlet. Additionally, the device does not effectively improve the electrical contact between the connectors.

Another locking electrical connector is disclosed in U.S. Pat. No. 4,627,681 to Hong. More particularly, the female contacts of the Hong patent each include a pair of moveable legs that may be wedged to press against the prongs or blades of a cooperating plug and lock the two in a coupled position. While this device is effective in retaining a plug and receptacle together as well in improving the electrical contact between the connectors, it also suffers from a number of disadvantages.

More particularly, the device does not include a locking plug or male connector. Accordingly, the device is not in any way effective in retaining a male connector in a standard wall outlet of the nonlocking type such as provided under the National Electrical Code as published by the National Fire Protection Association and as outlined in the standards of the National Electrical Manufacturers Association (NEMA) or the American National Standards Institute (ANSI). Stated another way, the male connector disclosed in Hong is only capable of locking with a wall outlet constructed in accordance with the teachings of Hong. Thus, the device disclosed in the Hong patent is of limited value and completely incapable of providing locking action when used with standard, general service nonlocking electrical outlets.

A need is therefore clearly identified for an improved electrical connector adapted to provide the desired locking function.

SUMMARY OF THE INVENTION

Accordingly, it is a primary object of the present invention to provide a locking electrical cord connector and method of positively engaging an electrical plug of an appliance in an electrical receptacle such as a general service wall outlet as found in every building with electrical service overcoming the above-described limitations and disadvantages of the prior art.

Another object of the present invention is to provide a locking electrical cord connector of relatively simple and inexpensive construction that may be conveniently operated to secure the electrical connection between the plug of an appliance and an electrical receptacle so that the appliance may be manipulated in the normal course of operation without disconnecting the plug from the receptacle. This apparatus may be particularly adapted for operation with conventional, nonlockable plugs and receptacles of the two-pole, two-wire and two-pole, three-wire types rated at 15 amperes and 125 volts and constructed in accordance with NEMA and ANSI standards or specifications.

Still another object of the present invention is to provide a method of positively engaging an electrical plug of an appliance in an electrical receptacle wherein the initial connection is relatively easily made and thereafter positive binding engagement is provided to resist inadvertent disconnection. Accordingly, the device may be utilized to maintain a good connection while manipulating the electrical appliance. In addition, the locking force may be sufficiently strong to prevent small children and toddlers from disconnecting the electrical plug of the appliance from the electrical receptacle thereby substantially reducing this shock hazard.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved locking electrical cord connector is provided. The connector of the present invention is related to the connector disclosed in parent U.S. patent application Ser. No. 664,456, the full disclosure of which is incorporated herein by reference.

The locking electrical cord connector includes a housing of electrically non-conductive material. A pair of cooperating conductors are provided in the housing. A male electrical contact is provided at one end of each of these conductors. A female electrical contact is provided at the opposite end.

The electrical cord connector also includes a first binding mechanism cooperating with the male electrical contact. A second, similar binding mechanism is provided cooperating with the female electrical contact. An actuator in the form of a lever controlled cam is also provided to allow the binding mechanisms to be manipulated between a locked or engaged position and an unlocked or disengaged position.

More particularly, the binding mechanisms each comprise a pair of spring metal retaining elements. One spring metal retaining element cooperates with each male and female contact. In particular, the distal end of each spring metal retaining element cooperating with a male contact is connected to the distal end of the male contact by, for example, bradding. The proximal end of each of these retaining elements passes through the outer wall of the housing and engages in a slot provided in a first slide block or plunger.

Each of the spring metal retaining elements associated with a female contact includes a distal end mounted in a slot cut in the housing. The proximal end of each of these retaining elements is similarly received in a slot in a second slide block. This slide block is identical to the first slide block that receives the proximal end of the spring metal retaining elements of the male contacts. The two slide blocks are received in separate chambers within the housing and adapted for reciprocal movement in opposing directions.

As indicated above, it is preferred that the actuating means take the form of a lever operated cam. More particularly, the cam includes opposing operative faces. One of these faces engages in a channel cut in the first slide block operating the spring metal retaining elements connected to the male contacts. The other face engages in an identical channel cut in the second slide block operating the spring metal retaining elements cooperatively operating with the female contacts.

When in an unlocked or disengaged position, the spring metal elements relax and straighten, providing the necessary clearance for the easy connection of the male contacts within an electrical wall outlet. Further, sufficient clearance is provided between the female contacts and their cooperating spring metal retaining elements to allow easy receipt of the plug of an electrical appliance.

When in an engaged or locked position, the slide blocks are forced outwardly to bow the spring metal retaining elements. This bowing provides positive frictional engagement and binds the male contacts within the electrical wall outlet while also squeezing, gripping and thereby binding the prongs or blades of the plug of the electrical appliance in the female contacts.

Preferably, the resulting frictional engagement is sufficiently strong to resist separation of the electrical cord connector from the wall outlet and the electrical appliance plug under normal use and operation. This allows an individual to freely manipulate the electrical appliance without worrying about the electrical connection coming uncoupled and effectively avoids that inconvenience in most instances.

Advantageously, it should be appreciated that the locking action described above is effectively provided when the locking cord connector is utilized with any standard or conventional general purpose nonlocking plug and receptacle of the two-pole, two-wire and two-pole, three-wire type rated at 15 amperes and 125 volts as outlined under NEMA and ANSI standards and specifications (see, for example, ANSI/UL 498-1980 and 498-1986). Thus, the present invention is particularly useful as it allows existing nonlocking plugs and receptacles to function as locking receptacles for the added convenience of, for example, the homeowner or other operator.

In accordance with a further aspect of the present invention, a method is provided for positively engaging an electrical plug of an appliance in an electrical receptacle utilizing a locking cord connector. The method includes the steps of operatively engaging the electrical plug of the appliance in a female end of the cord connector and the male end of the cord connector in the electrical receptacle. The electrical receptacle may be the female end of an extension cord or an electrical wall outlet. Next is the step of actuating the locking cord connector so as to provide a positive binding engagement between the female end of the cord connector and the electrical plug and the male end of the cord connector and the receptacle.

Advantageously, the locking cord connector allows relatively easy connection to the plug and receptacle. After connection and actuation, however, secure positive binding engagement is provided to resist disconnection of the cord connector from the plug and receptacle. Accordingly, the electrical appliance may be manipulated in a normal manner without inadvertently becoming disconnected from the power source. Further, the binding engagement provided is sufficiently strong to resist disconnection by small children and toddlers thereby reducing the risk of this potential shock hazard.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing:

FIG. 4 is an elevational view of one section of the housing showing the connector of the present invention in the unlocked or disengaged position;

FIG. 5 is similar to FIG. 4 showing the connector of the present invention in the locked or engaged position;

FIG. 6 is a cross-sectional view along line 6—6 of FIG. 4 showing the connector of the present invention in full line in the unlocked or disengaged position and in phantom line in the locked or engaged position; and FIG. 7 shows an alternative embodiment of the present invention wherein the male and female ends of the electrical cord connector are provided at opposite ends of an extension cord.

Reference will now be made in detail to the present preferred embodiment of the invention, an example of which is illustrated in the accompanying drawing.

DETAILED DESCRIPTION OF THE INVENTION

Figure 1:
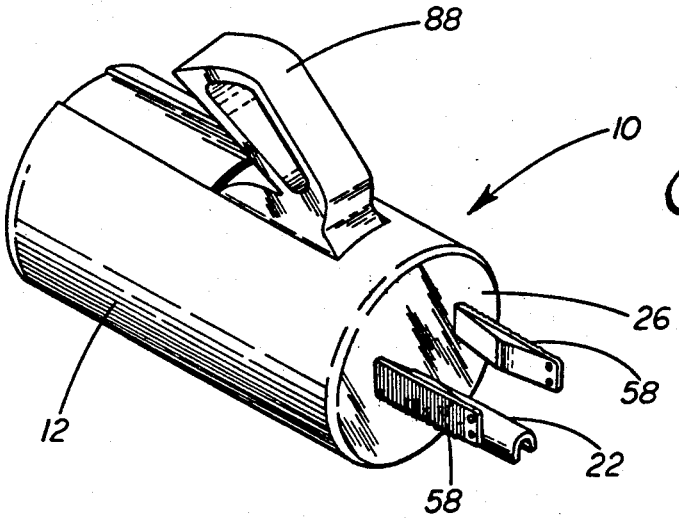
FIG. 1 is a perspective view of a locking electrical cord connector constructed in accordance with the teachings of the present invention.
Figure 2:
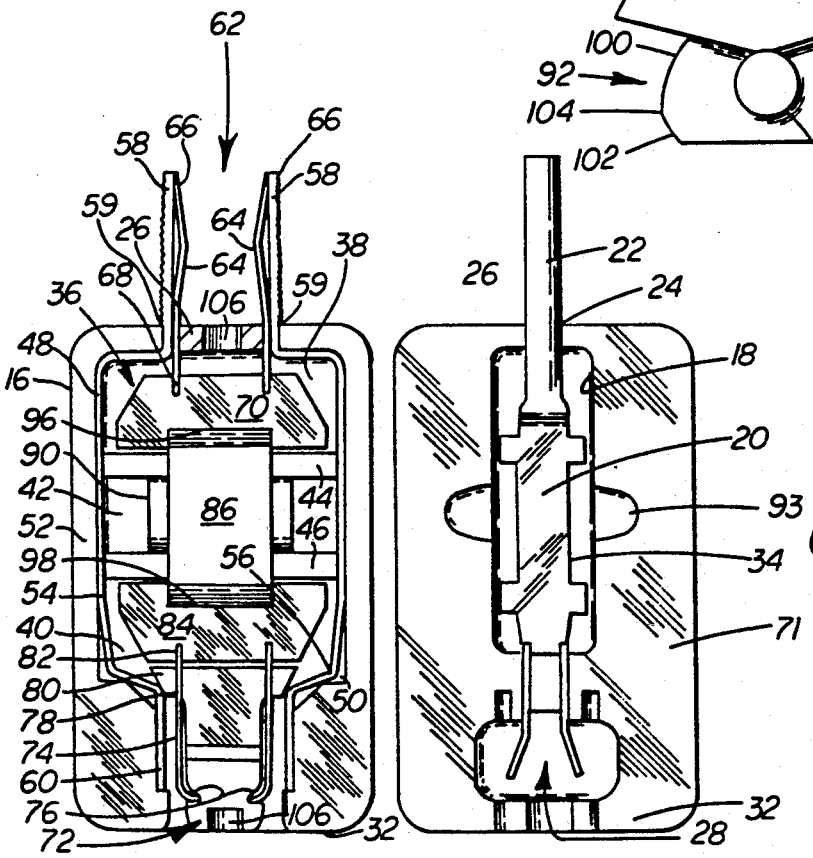
FIG. 2 is a plan view showing the two housing sections of the locking electrical cord connector shown in FIG. 1 in a separated condition.

Reference is now made to the drawing figures and particularly FIGS. 1 and 2 showing the locking cord connector 10 of the present invention. The connector 10 shown and described is particularly adapted for operation with any conventional or standard general purpose, nonlocking plug and/or receptacle of the two-pole, two-wire and two-pole, three-wire type rated at 15 amperes and 125 volts. Such standard plugs and receptacles are disclosed in NEMA and ANSI specifications as well as in the ANSI/UL 498 series publications. More particularly, such plugs and receptacles include NEMA Nos. 1-15P, 1-15R, 5-15P, 5-15R and ANSI Nos. C73.10 and C73.11. Of course, it should be appreciated that the principals of the invention are equally applicable to straight blade plugs and receptacles of other designs and configurations and, accordingly, the invention should not be viewed as being limited thereto.

The locking cord connector 10 includes a housing 12 formed from two cooperating halves or sections 14, 16. Preferably, each of the sections 14, 16 is molded from a strong, lightweight, electrically non-conductive material such as polyvinylchloride or ABS plastic.

As best shown in FIG. 2, the housing section 14 includes a cavity 18 sized to receive and hold a one-piece ground conductor 20. The ground conductor 20 includes a male contact end or prong 22 that extends through an opening in the end wall 26 of the housing 12. At the opposite end, the ground conductor 20 includes a female contact or prong receiving receptacle 28. An opening in the opposite end wall 32 opens to a passageway 30 that leads to the receptacle 28.

As shown, a relief 34 is molded into the housing section 14 at the bottom of the cavity 18. This relief 34 is shaped to match the profile of ground conductor 20 thereby insuring proper positioning thereof in the housing section 14 during manufacture. The same relief 34 also insures that the ground conductor 20 is positively held in operative position during use.

The housing section 16 also includes a cavity 36. The cavity 36 is divided into three chambers 38, 40 and 42 by the partitions 44, 46. A single piece positive conductor 48 made of, for example, brass snaps into a slot 50 molded into the housing section 16. The slot 50 extends through the end walls 26, 32 and between the partitions 44, 46 and the side wall 52. A single piece negative conductor 54, also of brass, snaps into a similar slot 56 provided in the opposite side of the housing section 16. The conductors 48 and 54 each include a male contact or prong 58 that projects through the slot 59 in the end wall 26 and a female contact 60 that is held within the relatively thick end wall 32. The relative spacing and positioning between the two male contacts 58 and the two female contacts 60, respectively, in the exemplary connector 10 being described is in accordance with NEMA, ANSI and UL specifications for two-pole, two-wire and two-pole, three-wire type plugs and receptacles rated at 15 amperes and 125 volts.

A locking mechanism generally designated as reference numeral 62 cooperates with the male contacts 58. More particularly, a spring metal element 64 is bradded at a distal end 66 to each male contact 58. The spring metal elements 64 are preferably made from beryllium copper and have, for example, a thickness of 0.012 inches to provide the desired durability for a long service life. A proximal end of each spring metal element 64 extends through the cooperating slot 59 in the end wall 26 and is engaged and held in a notch 68 in a plunger or slide block 70. As shown, the slide block 70 is received for limited reciprocal movement in the first chamber 38 defined by the end wall 26, side wall 52, partition 44 and inner face 71 of the housing section 14. Slide block 70 is preferably formed from a relatively rigid, electrically non-conductive plastic such as NORYL.

A locking mechanism generally designated by reference numeral 72 cooperates with the female contacts 60. More particularly, one spring metal element 74 cooperates with each female contact 60. Each element 74, like spring metal element 64, is made from beryllium copper and has, for example, a thickness of 0.012 inches. Each spring metal retaining element 74 is held in the housing section 16 at a distal end by a notch 76 and adjacent the proximal end by a notch 78. The upstanding, integral posts 80 of the housing section 16, projecting between the spring metal retaining elements 74 and the conductors 48 and 54, ensure that each spring metal element is maintained in proper spacing with respect to the cooperating female contact 60 so as to define an electrical receptacle capable of receiving the prongs of a plug of an electrical appliance cord.

The proximal end of each spring metal element 74 is received in a notch or slot 82 cut in the leading face of a slide block 84. The slide block 84 is identical to the slide block 70. The slide block 84 is received for limited reciprocal movement in the second chamber 40, defined by the partition 46, side wall 52, thickened end wall 32 and inner face 71 of the housing section 14.

Figure 3:
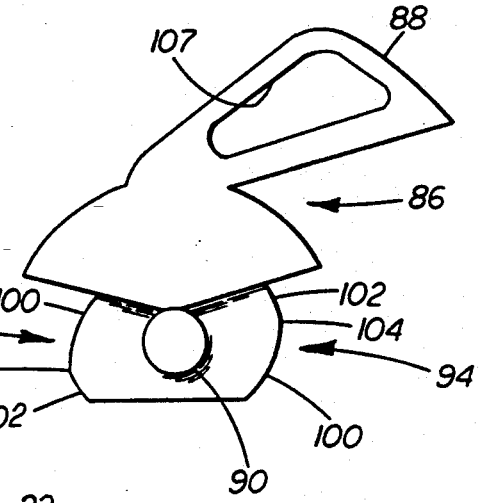
FIG. 3 is a side elevational view of the lever cam actuator of the connector of the present invention.

The locking mechanisms 62 and 72 are controlled by means of a hand manipulated actuator 86. As best shown in FIG. 3, the actuator 86 includes a lever 88 that may be manipulated to rotate the actuator about a molded, integral guide pin 90. As shown, the guide pin 90 includes a smooth circular outer surface that engages in the third chamber 42 defined between the partitions 44, 46 and the side wall 52. The thickened inner face 71 of the housing section 14 also includes relief basins 93 that capture the guide pin 90 at each end.

The fit of the integral guide pin 90 is relatively snug so as to substantially eliminate play. Rotative manipulation of the actuator 86 is made relatively easy, however, by molding the actuator of a low friction, non-electrically conductive material such as DELRIN. Such material reduces the frictional forces to allow for operation through the application of a lower overall manipulative force. Of course, the mechanical advantage provided by the lever 88 serves to multiply the force applied for manipulating the actuator 86 thereby further easing operation.

As best shown in FIG. 3, the actuator 86 includes opposed, operative cam faces 92, 94. Cam face 92 engages in a guide channel 96 in the trailing face of the slide block 70. The cam face 94 engages in a guide channel 98 in the trailing face of the slide block 84.

Each cam face 92, 94 includes two distinct radius portions 100, 102 separated by a high center line 104. In the unlocked or disengaged position (see FIGS. 1 and 4 and note phantom line position in FIG. 6) the two opposed cam portions 100, of relatively smaller overall radius, engage the slide blocks 70, 84. The high center line 104 provides a distinct clicking action and positively holds the locking cord connector 10 in the unlocked position.

In this position, the resilient memory of the spring metal elements 64, 74 causes them to straighten and press the slide blocks 70, 84 toward each other back against the cam faces 92, 94 (note actions arrows A in FIG. 4). As a result, the combined width of each male contact 58 and cooperating spring metal element 64 is reduced. Simultaneously, the width of the space defined between each female contact 60 and its cooperating spring metal element 74 is expanded (see also FIG. 2). As described below, this allows easy connection of the locking cord connector 10 to an electrical receptacle and a plug of an electrical appliance.

In the locked or engaged position (note full line position of actuator 86 in FIG. 6 and FIG. 5), the two opposed cam portions 102, of relatively larger overall radius, engage the slide blocks 70, 84, pushing the blocks outwardly (note actions arrows B in FIG. 5). Once again, the high center line 104 provides the desired "feel" for confident operation with a firm click. Further, the "over center" action firmly holds the locking cord connector 10 in the locked position. In this position, the slide block 70 presses the spring metal elements 64 outwardly. As each element 64 is fixed at its distal end to a cooperating male contact 58, the elements bow causing the overall width defined by each element and cooperating contact to increase. Further, the contacts 58 are flexed outwardly to increase the locking action.

Similarly, the slide block 84 presses the spring metal elements 74 outwardly. Since the elements 74 are fixed at their distal ends by abutting against the ends of the notches 76, the elements bow, closing the width of the space defined between the elements and the female contacts 60. This double action serves to increase the frictional grip and binds the locking cord connector 10 in an electrical receptacle such as a wall outlet and to an appliance plug in a manner described in greater detail below.

After dropping the conductors 20, 48, 54, spring metal elements 64, 74, slide blocks 70, 84 and actuator 86 into position in the respective housing sections 14, 16, the two housing sections are closed together with the projecting lugs 106 of the section 16 extending down into the cooperating slots 108 in the section 14. The two sections 14, 16 may then be fastened together as, for example, by heat welding to complete the production process.

It should be appreciated that the locking cord connector 10 is relatively simple to operate. First, the actuator 86 is positioned as shown in phantom line in FIG. 1 to unlock the locking mechanisms 62, 72. Advantageously, the split design of the lever 88 including the opening 107 allows the lever to be easily grasped between the thumb and index finger and then pulled upwardly. This allows the cam portions 102 to be released past the high center lines 104 and the cam portions 100 to be brought into engagement with the slide blocks 70, 84. As this occurs, the spring metal elements 64, 74 straighten. This reduces the effective width of the combined spring metal elements 64 and male contacts 58 while increasing the width of the space defined between the spring metal elements 74 and the female contacts 60.

As a result, the combined male contacts 58 and spring metal elements 64 may be easily inserted into an electrical receptacle such as a wall outlet to make one operative engagement or connection. Similarly, the female contacts 60 and spring metal elements 74 are open relatively wide to readily receive the prongs of a plug of an electrical appliance such as a vacuum cleaner to make another operative engagement or connection.

Once these operative connections are made, the actuator 86 is moved by means of the lever 88 into the full line position shown in FIG. 1. This movement brings the cam portions 102 into engagement with the slide blocks 70, 84 forcing them outward. Advantageously, the high center lines 104 of the cam faces 92, 94 provide a clicking action indicating complete engagement. As a result of the outward movement of the slide blocks 70, 84, the spring metal elements 64, 74 are bowed. Accordingly, the spring metal elements 64 and male contacts 58 fill the female contacts of the receptacle or wall outlet. Further, the contacts 58 are spread in the receptacle (note action arrows C in FIG. 5) frictionally binding the locking cord connector 10 in a "plugged in" position. Simultaneously, the bowing of the spring metal elements 74 serves to squeeze the prongs of the appliance cord between the spring metal elements and the female conductors 60 thereby binding the plug in a connected position. In fact, a frictional binding force of sufficient strength may be provided to resist disconnection at either end under a dead pull weight of at least 10 and up to 250 pounds, depending upon design specifications. If desired, serrations or teeth 110 may be cut into the contacts 58, 60 to increase the binding action. Of course, the tight binding action also ensures good electrical contact and flow.

In an alternative embodiment 10' shown in FIG. 7, a first housing 120 is provided at one end of a flexible conductor 122 and a second housing 124 is provided at the opposite end. The first housing 120 includes an actuator **86*a*, having a single operative cam face engaging a single slide block (not shown), for operating spring metal elements (not shown) associated with male contacts 58. The second housing 124 includes an actuator 86*b***, having a single operative cam face engaging a single slide block (not shown) for operating spring metal elements (not shown) associated with female contacts (also not shown) of the design described above with respect to the main embodiment. The actuators 86a, 86b allow an individual to selectively lock the male and female ends 126, 128 of the extension cord arrangement 10' to a standard or conventional receptacle and a standard or conventional appliance plug, respectively, in the manner described above with respect to the primary embodiment.

In summary, numerous benefits have been described which result from employing the concepts of the present invention. Advantageously, the locking cord connector 10 of the present invention substantially eliminates the possibility of a nonlocking appliance plug of conventional design from becoming inadvertently unplugged from a nonlocking receptacle of conventional design during normal manipulation of the electrical appliance. Advantageously, the locking cord connector 10 achieves this end through a relatively simple and inexpensive design that provides reliable operation over an extended service life.

The apparatus 10 of the present invention may be conveniently utilized by the simple manipulation of a single lever 88 so as to substantially eliminate the annoying and frustrating problem of disconnection of an electrical appliance from a power source. Further, the binding of the male contacts 58 of the locking cord connector 10 within the receptacle and the squeezing of the plug of the electrical appliance serves to enhance the electrical contact to ensure good conduction of electricity from the receptacle through the connector 10 to the electrical appliance.

The foregoing description of a preferred embodiment of the invention has been presented for purposes of illustration and description. It is not intended to be exhaustive or to limit the invention to the precise form disclosed. Obvious modifications or variations are possible in light of the above teachings.

For example, as also covered in the following claims, a locking mechanism of the type described could be fitted to the male and female ends of the ground conductor 20 in two-pole, three-wire connector designs. In such a situation, the locking mechanisms 62, 72 associated with the positive and negative electrical conductors 48, 54 may be eliminated if desired.

The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A locking electrical cord connector, comprising:
a housing of electrically non-conductive material;
a male electrical contact held in said housing;
first means cooperating with said male electrical contact for positively binding said male electrical contact in a standard receptacle as defined by NEMA/ANSI specifications;
a female electrical contact held in said housing;
a second means cooperating with said female electrical contact for positively binding said female electrical contact to a standard plug of another electrical appliance, said standard plug being defined by NEMA/ANSI specifications; and
means for selectively actuating said first and second binding means whereby said electrical cord connector may be relatively easily connected to said receptacle and plug while following actuation, positive binding action is provided to resist inadvertent disconnection that might otherwise occur during normal use of said electrical appliance.

2. The locking electrical cord connector set forth in claim 1, wherein said first binding means includes a first spring metal retaining element and said second binding means includes a second spring metal retaining element; said first and second spring metal retaining elements being selectively bowable to provide binding action.

3. The locking electrical cord connector set forth in claim 2, wherein said first binding means includes a first slide block and said second binding means includes a second slide block; both said slide blocks being mounted for reciprocal movement within a cavity in said housing.

4. The locking electrical cord connector set forth in claim 3, wherein said first spring metal retaining element includes a proximal end and a distal end, said proximal end of said first spring metal retaining element being connected to said first slide block and said distal end of said first spring metal retaining element being connected to said male contact and wherein said second spring metal retaining element includes a proximal end and a distal end, said proximal end of said second spring metal retaining element being connected to said second slide block and said distal end of said second spring metal retaining element being connected to said housing.

5. The locking electrical cord connector set forth in claim 4, wherein said actuating means includes a lever operated cam positioned between said first and second slide blocks within said housing, said cam having opposed operative faces for engaging said slide blocks and providing over-center locking action; said lever operated cam being selectively positionable between a locked position wherein said first and second spring metal retaining elements are bowed to provide binding engagement with said receptacle and plug sufficiently strong to resist inadvertent disconnection and an unlocked position wherein said spring metal retaining elements are relaxed and straightened by resilient memory to reduce the force of frictional engagement of said cord connector with said receptacle and plug.

6. The locking electrical cord connector set forth in claim 1, wherein said plug and receptacle are of the two-pole, two-wire or two-pole, three-wire type rated at 15 amperes and 125 volts.

7. A locking electrical cord connector, comprising:
a housing of electrically non-conductive material;
a male electrical contact held in said housing;
first means for locking said male electrical contact to a receptacle in the absence of any cooperating/reciprocating locking element on said receptacle;
a female electrical contact held in said housing;
second means for locking said female electrical contact to a plug of another electrical appliance in the absence of any cooperating/reciprocating locking element on said plug and electrical appliance; and
means for actuating said first and second locking means whereby in a locked position said locking means positively secures said connector to said receptacle and said plug with a frictional force sufficient to resist inadvertent disconnection and in an unlocked position said connector may be relatively easily connected to/disconnected from said receptacle and plug.

8. The locking electrical cord connector as set forth in claim 7, wherein said first locking means includes a first spring metal retaining element and said second locking means includes a second spring metal retaining element; said first and second spring metal retaining elements being selectively bowable to provide binding action.

9. The locking electrical cord connector as set forth in claim 8, wherein said first locking means includes a first slide block and said second locking means includes a second slide block; both said slide blocks being mounted for reciprocal movement within a cavity in said housing.

10. The locking electrical cord connector set forth in claim 9, wherein said first spring metal retaining element includes a proximal end and a distal end, said proximal end of said first spring metal retaining element being connected to said first slide block and said distal end of said first spring metal retaining element being connected to said male contact and wherein said second spring metal retaining element includes a proximal end and a distal end, said proximal end of said second spring metal retaining element being connected to said second slide block and said distal end of said second spring metal retaining element being connected to said housing.

11. The locking electrical cord connector set forth in claim 10, wherein said actuating means includes a lever operated cam positioned between said first and second slide blocks within said housing, said cam having opposed operative faces for engaging said slide blocks and providing over-center locking action; said lever operated cam being selectively positionable between a locked position wherein said first and second spring metal retaining elements are bowed to provide binding engagement with said receptacle and plug sufficiently strong to resist inadvertent disconnection and an unlocked position wherein said spring metal retaining elements are relaxed and straightened by resilient memory to reduce the force of frictional engagement of said cord connector with said receptacle and plug.

12. The locking electrical cord connector as set forth in claim 7, wherein said receptacle and plug are of the two-pole, two-wire type rated at 15 amperes and 125 volts in accordance with NEMA and ANSI specifications.

13. A method for positively locking a plug of an electrical appliance in a receptacle such as an electrical wall outlet utilizing a locking electrical cord connector having operative male and female ends, comprising the steps of:

unlocking said locking cord connector;

operatively engaging said plug of said electrical appliance in said female end of said locking cord connector;

operatively engaging said male end of said locking cord connector in said receptacle; and locking said locking cord connector so as to provide a positive binding engagement sufficiently strong to resist inadvertent disconnection of said connection between said locking cord connector and said plug and said receptacle, said locking being provided by expanding said operative male end of said locking cord connector so as to bind in said receptacle and converging said operative female end of said locking cord connector so as to squeeze and grip said plug.

14. The method for locking as set forth in claim 13, wherein said plug and receptacle are standard two-pole, two-wire and two-pole, three-wire types rated at 15 amperes and 125 volts as defined by NEMA/ANSI specifications.

15. A locking electrical cord connector comprising:

a first housing of electrically non-conductive material;

a male electrical contact held in said first housing;

first means for positively binding said male electrical contact in a standard receptacle as defined by NEMA/ANSI specifications;

first means for actuating said first binding means;

a second housing of electrically non-conductive material;

a female electrical contact held in said second housing;

second means for positively binding said female electrical contact to a standard plug of another electrical appliance, said standard plug being defined by NEMA/ANSI specifications;

a second means for activating said second binding means; and flexible conductor means for operatively connecting said male and female electrical contacts together extending between said first and second housings;

whereby said electrical cord connector may be easily connected to said receptacle and plug while following actuation, positive binding action is provided to resist inadvertent disconnection that might otherwise occur during normal use of said electrical appliance.

16. A locking electrical cord connector, comprising:

a first housing of electrically non-conductive material;

a male electrical contact held in said first housing;

first means for locking said male electrical contact to a receptacle in the absence of any cooperating/reciprocating locking element on said receptacle;

first means for actuating said first locking means;

a second housing of electrically non-conductive material;

a female electrical contact held in said second housing;

second means for locking said female electrical contact to a plug of another electrical appliance in the absence of any cooperating/reciprocating locking element on said plug and electrical appliance;

second means for actuating said second locking means; and flexible conductor means for operatively connecting said male and female electrical contacts together extending between said first and second housings;

whereby in a locked position said first and second locking means positively secure said connector to said receptacle and said plug with a frictional force sufficient to resist inadvertent disconnection and in an unlocked position said connector may be relatively easily connected to/disconnected from said receptacle and plug.

17. The locking electrical cord connector as set forth in claim 16, wherein said receptacle and plug are of the two-pole, three-wire type rated at 15 amperes and 125 volts in accordance with NEMA and ANSI specifications.

* * * * *